US007080902B2

(12) United States Patent
Hong et al.

(10) Patent No.: US 7,080,902 B2
(45) Date of Patent: Jul. 25, 2006

(54) INK JET PRINTER

(75) Inventors: Yun-gi Hong, Gyeonggi-do (KR); Jun-won Bae, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 86 days.

(21) Appl. No.: 10/183,044

(22) Filed: Jun. 27, 2002

(65) Prior Publication Data

US 2003/0081083 A1 May 1, 2003

(30) Foreign Application Priority Data

Oct. 31, 2001 (KR) ..... 2001-67616

(51) Int. Cl.
*B41J 2/01* (2006.01)

(52) U.S. Cl. ..... 347/104; 347/108

(58) Field of Classification Search ..... 347/104, 347/108; 400/624–629, 691, 693; 271/145–171; 399/393, 392, 405
See application file for complete search history.

(56) References Cited

U.S. PATENT DOCUMENTS

| | | | | |
|---|---|---|---|---|
| 5,620,269 | A * | 4/1997 | Gustafson | 400/624 |
| 5,757,407 | A * | 5/1998 | Rezanka | 347/102 |
| 6,042,109 | A * | 3/2000 | Klausbruckner | 271/225 |
| 6,085,063 | A * | 7/2000 | Morita et al. | 399/381 |
| 6,511,172 | B1 * | 1/2003 | Tanno et al. | 347/104 |

* cited by examiner

*Primary Examiner*—Stephen Meier
*Assistant Examiner*—Ly T. Tran
(74) *Attorney, Agent, or Firm*—Staas & Halsey LLP

(57) ABSTRACT

An ink-jet printer includes a paper supply unit having a paper supply plate and a pickup roller, a transferring unit transferring the paper, a printing unit which includes an ink cartridge and performs a printing process of printing an image on the paper, and an exhaust unit having an exhaust plate. The paper supply plate and the exhaust plate are spaced-apart from each other at a predetermined interval and are installed parallel to each other, and the paper supply unit is disposed at an upper portion of the exhaust unit, and the ink cartridge is disposed between the paper supply unit and the exhaust unit. Accordingly, a slimmed ink-jet printer having a compact and neat design can be achieved.

10 Claims, 4 Drawing Sheets

INK JET PRINTER

CROSS-REFERENCE TO RELATED APPLICATIONS

This application claims the benefit of Korean No. 2001-67616, filed Oct. 31, 2001, in the Korean Industrial Property office, the disclosure of which is incorporated herein by reference.

BACKGROUND OF THE INVENTION

1. Field of the Invention

The present invention relates to an ink-jet printer, and more particularly, to an ink-jet printer having a compact structure.

2. Description of the Related Art

In general, an ink-jet printer is an apparatus in which an ink cartridge is mounted on a carriage to move in a horizontal direction and eject ink onto a surface of paper to print an image or a character.

In the ink-jet printer, there are two conventional paper transferring methods. In a first paper transferring method, a paper supply cassette on which paper is stacked is installed to be inclined with respect to a rear side of a frame. The paper is transferred to a printing unit by a pickup roller to be printed and then is exhausted (discharged) to an exhaust unit disposed at a front side of the frame. In a second paper transferring method, the paper supply cassette on which the paper is stacked is installed at a lower portion of the frame, and the paper is transferred to the printing unit by the pickup roller to be printed and then is exhausted to the exhaust unit disposed at an upper portion of the paper supply cassette.

FIGS. 1 and 2 are a perspective view and a cross-sectional view of an ink-jet printer using the first paper transferring method, respectively. Referring to FIGS. 1 and 2, the ink-jet printer includes a paper supply cassette 11 containing paper P, a pickup roller 12 picking up the paper P, a feed roller 13 transferring the paper P, a printing unit printing the paper P, and an exhaust plate 16 to which the printed paper P is exhausted.

The paper supply cassette 11 is installed to be inclined with respect to a rear side of a printer frame 20. The paper P stacked on the paper supply cassette 11 is picked up by the pickup roller 12, is transferred to the feed roller 13, and then is transferred to an ink cartridge 14 of the printing unit by the feed roller 13. The ink cartridge 14 mounted on a carriage (not shown) moves right and left along a guide shaft (not shown) and ejects ink onto the paper P through a print head to perform a printing process. Finally, the paper P is stacked on the exhaust plate 16 installed at a front side of the printer frame 20 through an exhaust unit 17 by an exhaust roller 15.

In the ink-jet printer having the above structure, since the paper supply cassette 11 on which the paper P is stacked is installed at the rear side of the printer frame 20, a height of the ink-jet printer is increased. As a result, a large space is required to accommodate the ink-jet printer.

FIGS. 3 and 4 are an external perspective view and an internal perspective view of an ink-jet printer using the second paper transferring method, respectively. Referring to FIGS. 3 and 4, a paper supply cassette 21 on which a paper P is stacked is installed at a lower portion of a front side of a printer frame 30. A feed roller (not shown) driven by a line feed motor 31 is installed at an entrance of a printer frame 30. The paper P stacked on the paper supply cassette 21 is picked up by a pickup roller, a friction roller (not shown) is installed to be in contact with an upper side of the feed roller, an exhaust roller (not shown) rotates by a rotation force from the feed roller and is installed along a paper transferring path, and a star wheel (not shown) is installed at an upper portion of the exhaust roller.

The star wheel that is in contact with the exhaust roller applies a predetermined pressure to the paper P so that the paper P travels in a predetermined direction, and the exhaust roller rotates at the same linear velocity as that of the feed roller by a rotation force of the feed roller. An ink cartridge 24 that moves right and left by a carriage motor 32 along a guide shaft 33 and performs a printing process onto the paper P is installed along the paper transferring path between the feed roller and the exhaust roller, and an exhaust plate 26 on which the printed paper P is stacked is installed at an upper portion of the paper supply cassette 21.

In the above structure of the ink-jet printer, the paper P picked up by the pickup roller from the paper supply cassette 21 is transferred by the feed roller and by the friction roller, and the printing process is performed by the ink cartridge 24 installed between the feed roller and the exhaust roller. Next, the paper P is exhausted by the exhaust roller and the star wheel and then is stacked on the exhaust plate 26 installed at the upper portion of the paper supply cassette 21.

In the conventional ink-jet printer, since the ink cartridge 24 is disposed on the paper P transferred to the exhaust roller, a height of the printer frame 30 is increased. As a result, a large space is required to accommodate the conventional ink-jet printer.

SUMMARY OF THE INVENTION

To solve the above and other problems, it is an object of the present invention to provide an ink-jet printer having a slimmed size by modifying an internal structure of the ink-jet printer, thereby the ink-jet printer has a compact and neat design to be changed from a peripheral device of a personal computer (PC) to a central portion of home networking and to simultaneously allow a user of the Internet age to easily select a digital printing which is desired by the user in the Internet TV age.

Additional objects and advantageous of the invention will be set forth in part in the description which follows and, in part, will be obvious from the description, or may be learned by practice of the invention.

Accordingly, to achieve the above and other objects, there is provided an ink-jet printer. The ink-jet printer includes a paper supply unit having a paper supply plate on which paper is stacked, and a pickup roller picking up the paper stacked on the paper supply plate, a transferring unit transferring the paper picked up by the paper supply unit, a printing unit having an ink cartridge to perform a printing process onto the paper transferred from the transferring unit, and an exhaust unit having an exhaust plate in which the paper printed by the printing unit is exhausted (discharged) and stacked.

The paper supply plate and the exhaust plate are spaced-apart from each other at a predetermined interval and are installed in parallel with each other, and the paper supply unit is disposed at an upper portion of the exhaust unit, and the ink cartridge is disposed between the paper supply unit and the exhaust unit.

It is possible that the paper supply plate and the exhaust plate are selectively drawn into and projected from the ink-jet printer when the paper is supplied, received, exhausted, or removed.

It is also possible that the ink-jet printer further includes a cover which selectively opens and closes the paper supply plate to cover and uncover a space in which the paper is stacked.

BRIEF DESCRIPTION OF THE DRAWINGS

The above and other objects and advantages of the present invention will become apparent and more readily appreciated from the following description of the preferred embodiments, taken in conjunction with the accompanying drawings in which.

DETAILED DESCRIPTION OF THE PREFERRED EMBODIMENTS

Figure 1:
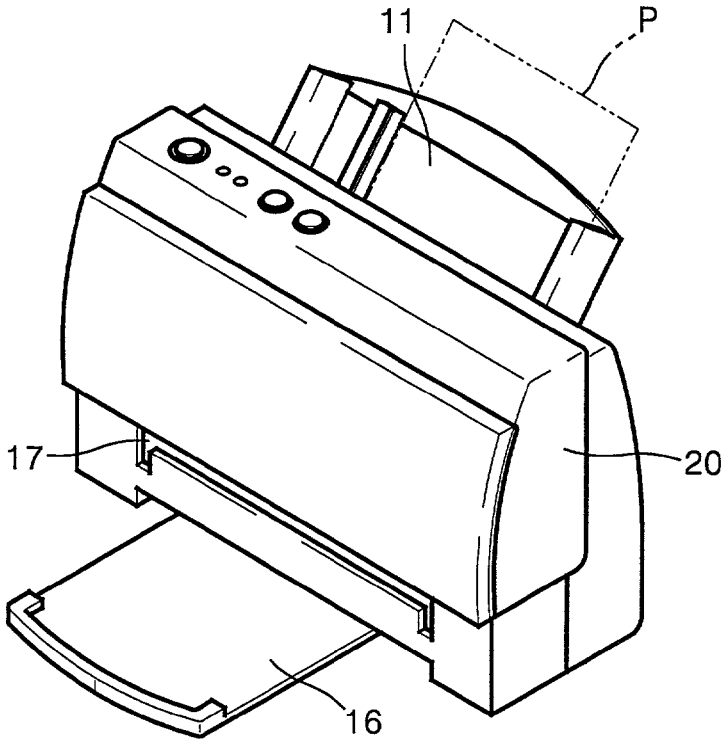
FIG. 1 (PRIOR ART)
FIG. 1 is a perspective view of a conventional ink-jet printer.
Figure 2:
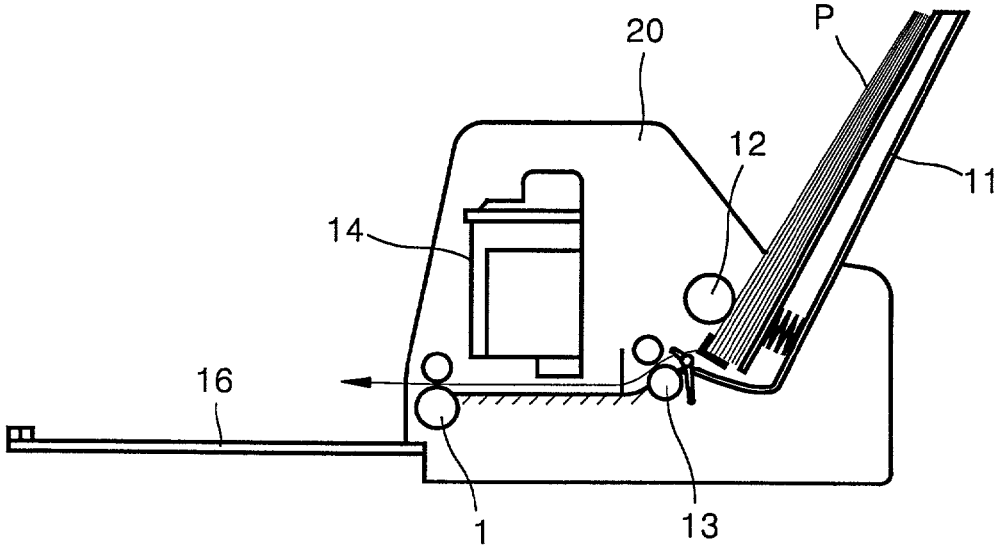
FIG. 2 (PRIOR ART)
FIG. 2 is a cross-sectional view of the ink-jet printer shown in FIG. 1.
Figure 3:
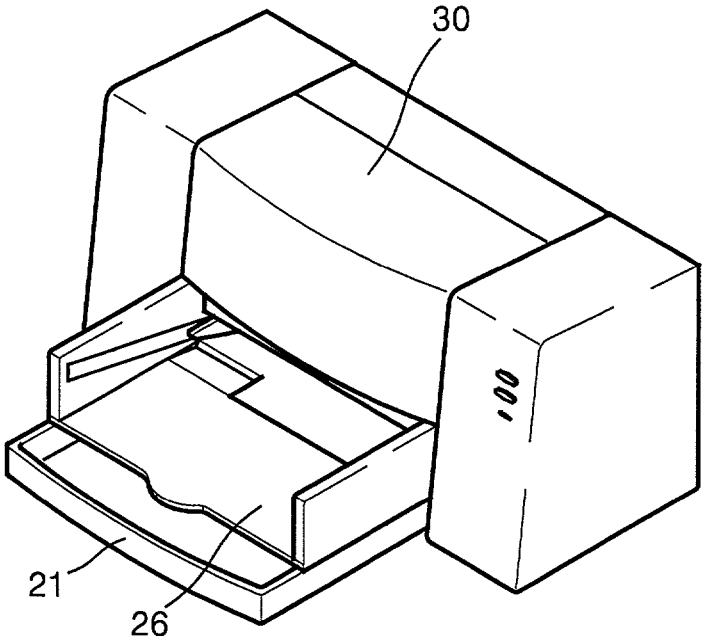
FIG. 3 (PRIOR ART)
FIG. 3 is an external perspective view of another conventional ink-jet printer.
Figure 4:
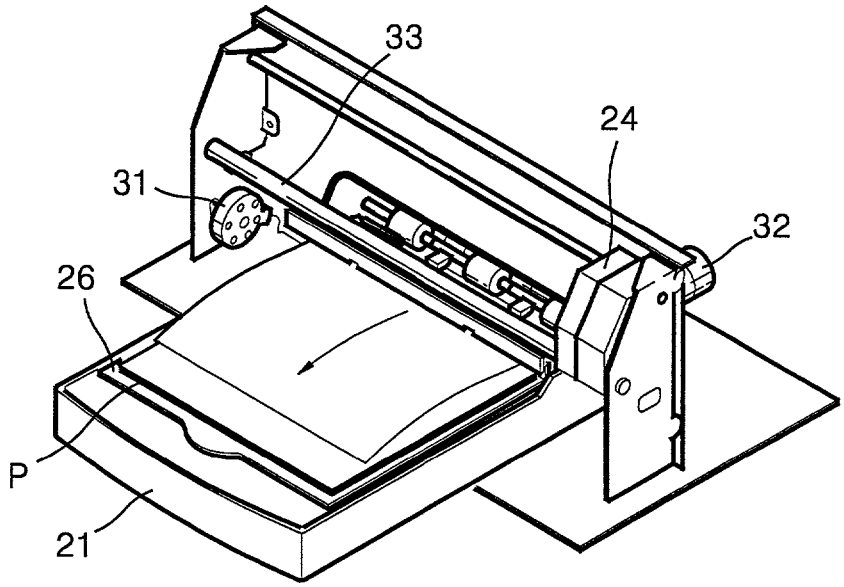
FIG. 4 (PRIOR ART)
FIG. 4 is an internal perspective view of the ink-jet printer shown in FIG. 3.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

An embodiment of the present invention will be described in detail with reference to the accompanying drawings.

Figure 5:
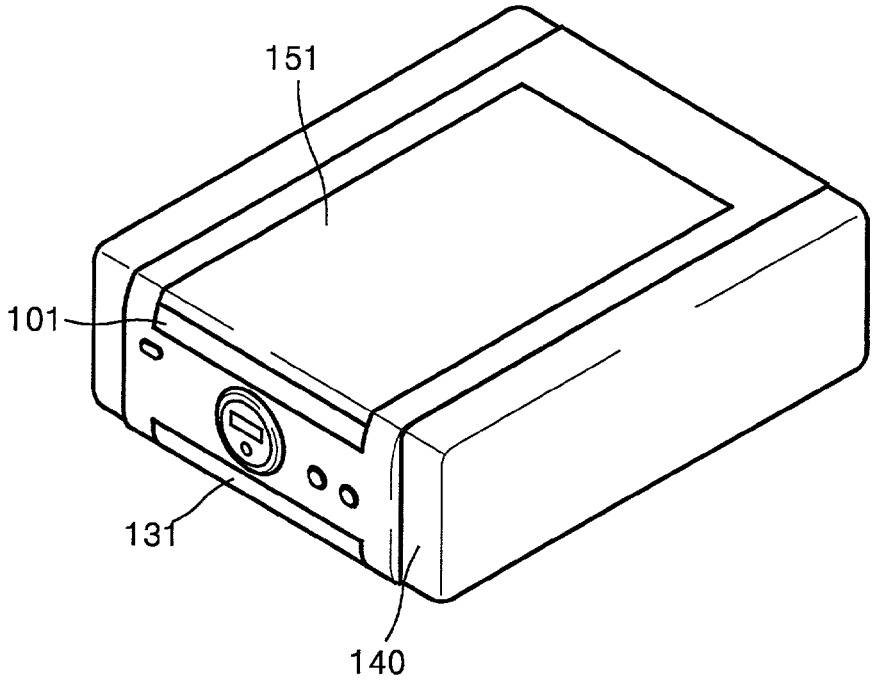
FIG. 5 is a perspective view of an ink-jet printer according to an embodiment of the present invention.
Figure 6:
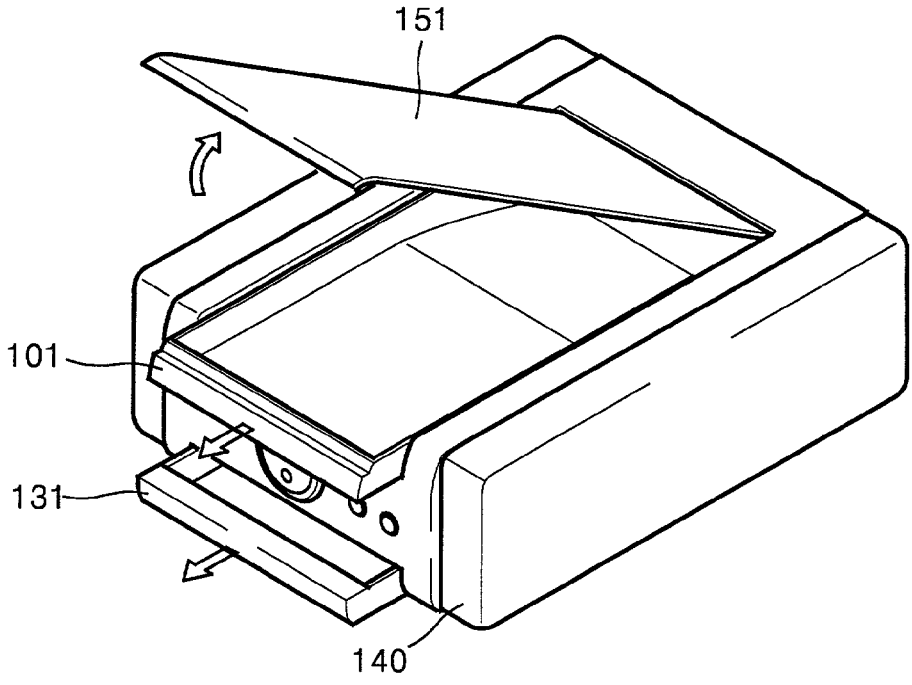
FIG. 6 is a perspective view showing an opened state of the ink-jet printer shown in FIG. 5.
Figure 7:
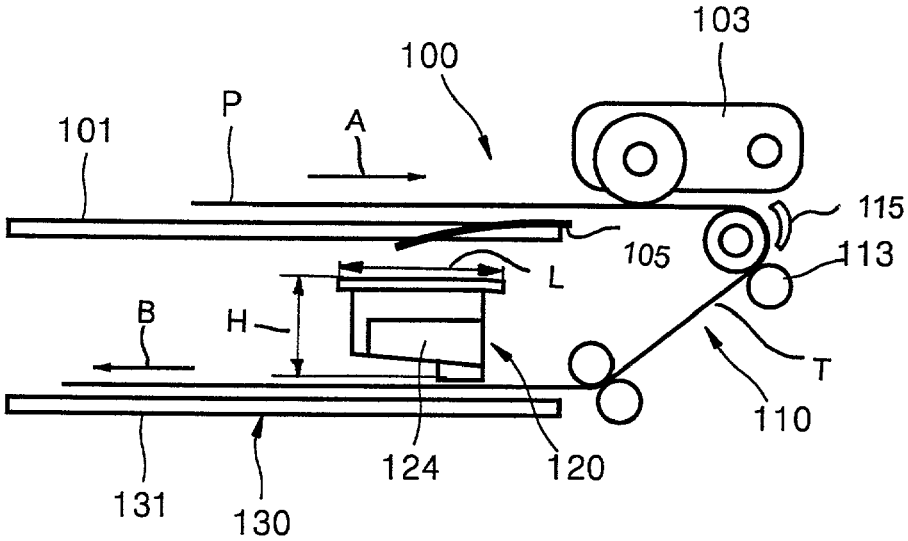
FIG. 7 is a cross-sectional view illustrating an internal structure of the ink-jet printer of FIG. 3.
Figure 8:
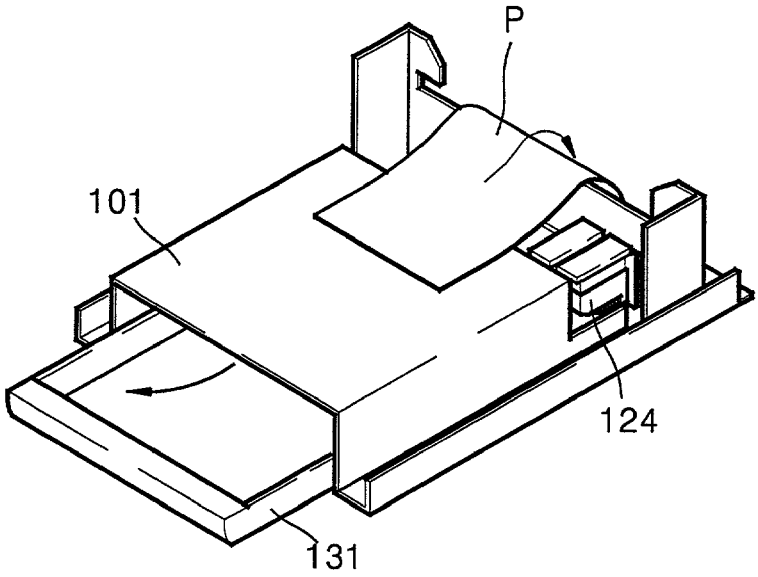
FIG. 8 is a perspective view illustrating a traveling path of paper in the ink-jet printer of FIG. 3.

FIGS. 5 through 8 illustrate an ink-jet printer according to the embodiment of the present invention. FIG. 5 is a perspective view of an appearance of the ink-jet printer in a closed state, and FIG. 6 shows the ink-jet printer having a paper supply plate, an exhaust plate, and a cover in an opened state. In addition, FIG. 7 is a cross-sectional view illustrating an internal structure of the ink-jet printer, and FIG. 8 illustrates a traveling path of paper in the ink-jet printer.

Referring to FIGS. 5 through 8, the ink-jet printer includes a paper supply unit 100, a transferring unit 110, a printing unit 120, and an exhaust unit 130. The paper supply unit 100 includes a paper supply plate 101 on which paper P to be printed is stacked, a spring 105 pushing the paper P upward, and a pickup roller 103 picking up the paper P. The paper supply plate 101 is installed at an upper portion of the ink-jet printer and is drawn into and projected from a frame 140 to receive the paper P.

The transferring unit 110 includes a plurality of feed rollers 103 transferring the paper P to the printing unit 120 and a guide plate 115 guiding the paper P from the paper supply unit 110 to the printing unit 120. The printing unit 120 includes an ink cartridge 124 to perform a printing process of printing an image on the paper P transferred from the transferring unit 110. The exhaust unit 130 exhausts (discharges) the paper P printed by the printing unit 120 and stacks the printed paper P on an exhaust plate 131. The exhaust plate 131 is installed at a lower portion of the ink-jet printer and drawn into and projected from the frame 140 to receive the printed paper P from the printing unit 120.

As shown in FIG. 7, the paper supply unit 100 and the exhaust unit 130 are spaced-apart from each other at a predetermined interval and are disposed in parallel with each other. The ink cartridge 124 is disposed between the paper supply unit 100 and the exhaust unit 130. Meanwhile, a cover 151 is installed on the paper supply plate 101 to selectively open and shut the paper supply plate 101 to cover a space in which the paper P is stacked, and the cover 151 may be opened when the paper P is stacked on the exhaust plate of the paper supply unit 100 or when the ink cartridge 24 is replaced.

In the ink-jet printer having the above structure, the paper P is fed from the paper supply unit 100 disposed at an upper portion of the printer in a direction of an arrow A as shown in FIG. 7, and the paper P passes the transferring unit 110 and the printing unit 120 along a traveling path C and is exhausted in a direction of an arrow B to the exhaust unit 130 disposed at the lower portion of the ink-jet printer as shown in FIG. 7. More specifically, the paper P stacked on the paper supply plate 101 is picked up by the pickup roller 103, transferred to the transferring unit 110 and the ink cartridge 124 of the printing unit 120 by a transferring roller 113 of the transferring unit 110.

The ink cartridge 124 mounted on a carriage (not shown) moves right and left along a guide shaft (not shown) by a carriage motor (not shown) and ejects ink onto the paper P through a print head (not shown), thereby performing the printing process. In this case, the ink cartridge 124 disposed between the paper supply unit 100 and the exhaust unit 130 has a lower height H and a longer length L than that of a conventional ink cartridge. The length L may be equal to or greater than the height H. As a result, the ink-jet printer may be much slimmed than the conventional ink-jet printer. Finally, the paper P printed by the printing unit 120 is exhausted and is stacked on the exhaust plate 131.

As described above, in the ink-jet printer according to the embodiment of the present invention, an ink cartridge having a lower height and a longer length than that of a conventional ink cartridge is installed between a paper supply unit and an exhaust unit, and thereby the ink-jet printer can be much slimmer than the conventional ink-jet printer. The paper supply plate and the exhaust plate which can be completely drawn into and projected from a frame of the ink-jet printer, and a cover which can be opened and shut, are included in the ink-jet printer, and thereby a compact and neat design can be satisfied. Further, owing to the slimmed structure, a vertical space to accommodate the ink-jet printer can be reduced.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. An ink-jet printer, comprising:

a paper supply unit having a paper supply plate on which paper is stacked, and a pickup roller picking up the paper stacked on the paper supply plate;

a transferring unit for transferring the paper picked up by the paper supply unit;

a printing unit having an ink cartridge to perform a printing process of printing an image on the paper transferred from the transferring unit;

a discharge unit having a discharge plate in which the paper printed by the printing unit is discharged and stacked; and a cover covering and uncovering a space of the paper supply unit in which the paper is stacked, wherein:

the paper supply plate and the discharge plate are spaced-apart from each other by a predetermined interval and are substantially parallel to each other, the paper supply unit is disposed at an upper portion of the discharge unit, and the ink cartridge is disposed between the paper supply unit and the discharge unit.

2. The ink-jet printer of claim 1, wherein the paper discharge plate is drawn into and projected from the printer.

3. An ink-jet printer, comprising:

a paper supply unit having a paper supply plate on which paper is stacked, and a pickup roller picking up the paper stacked on the paper supply plate;

a transferring unit for transferring the paper picked up by the paper supply unit;

a printing unit having an ink cartridge to perform a printing process of printing an image on the paper transferred from the transferring unit;

a discharge unit having a discharge plate in which the paper printed by the printing unit is discharged and stacked, the discharge plate being movable with respect to the ink-jet printer so as to be projected from the ink-jet printer to remove the printed paper; and a cover opening and closing a space of the paper supply unit in which the paper is stacked; wherein:

the paper supply plate is substantially parallel to the discharge plate and is spaced-apart from the discharge plate by a predetermined interval, and is drawn into the ink-jet printer to supply to the pickup roller and is projected from the ink-jet printer to receive the paper;

the paper supply unit is disposed at an upper portion of the discharge unit; and the ink cartridge is disposed between the paper supply unit and the discharge unit.

4. An ink-jet printer printing paper, comprising:

a paper supply unit supplying the paper;

a printing unit printing the paper supplied from the paper supply unit; and a paper discharge unit disposed substantially parallel to the paper supply unit to discharge the printed paper, wherein:

the printing unit is disposed between the paper supply unit and the paper discharge unit, the printing unit comprises an ink-jet cartridge, and the ink cartridge has a length being measured in one of a paper supply direction and a paper discharge direction and being equal to or greater than a height of the ink cartridge.

5. An ink-jet printer printing paper, comprising:

a paper supply unit supplying the paper;

a printing unit printing the paper supplied from the paper supply unit; and a paper discharge unit disposed substantially parallel to the paper supply unit to discharge the printed paper, wherein:

the printing unit is disposed between the paper supply unit and the paper discharge unit, the printing unit comprises an ink-jet cartridge, and the ink cartridge has a length being measured in one of a paper supply direction and a paper discharge direction and being greater than a distance between the paper supply unit and the paper discharge unit.

6. An ink-jet printer printing paper, comprising:

a paper supply unit supplying the paper;

a printing unit printing the paper supplied from the paper supply unit; and a paper discharge unit having a discharge plate and disposed substantially parallel to the paper supply unit to discharge the printed paper;

a frame and a cover coupled to the frame to covers and uncovers the paper supply unit, wherein:

the printing unit is disposed between the paper supply unit and the paper discharge unit, and the discharge plate is drawn into the ink-jet printer to receive the printed paper from the printing unit and is projected from the ink-jet printer to remove the printed paper, wherein the paper supply unit comprises a paper supply plate on which the paper is stacked, and the paper discharge unit comprises a paper discharge plate on which the printed paper is discharged, the paper supply plate being parallel to the paper discharge unit, wherein the paper supply plate is drawn into the frame and projected from the frame.

7. The ink-jet printer of claim 6, wherein the cover is not projected from an outer surface formed by the frame when the cover covers the paper supply unit.

8. The ink-jet printer of claim 6, wherein the paper supply plate, the paper discharge plate, and a cover are not projected from an outer surface of the frame when the cover covers the paper supply unit and when the paper supply plate and the paper discharge plate are drawn into the frame.

9. The ink-jet printer of claim 6, wherein the paper supply plate, the paper discharge plate, a cover, and a frame form a box-like shape when the cover covers the paper supply unit and when the paper supply plate and the paper discharge plate are drawn into the frame.

10. An ink-jet printer printing paper, comprising:

a paper supply unit having a paper supply plate on which the paper is stacked;

a paper discharge unit having a paper discharge plate disposed substantially parallel to the paper supply plate of the paper supply unit and receive the printed paper; and an ink cartridge disposed between the paper supply unit and the paper discharge unit to print the paper;

wherein the paper discharge plate is drawn into and projected from the frame;

wherein the paper is supplied in a first direction, and the printed paper is discharged in a second direction opposite to the first direction;

wherein the ink cartridge has a height being less than a length of the ink cartridge and less than a distance between the paper supply plate and the paper discharge plate.

* * * * *

UNITED STATES PATENT AND TRADEMARK OFFICE

CERTIFICATE OF CORRECTION

PATENT NO. : 7,080,902 B2
APPLICATION NO. : 10/183044
DATED : July 25, 2006
INVENTOR(S) : Yun-gi Hong et al.

It is certified that error appears in the above-identified patent and that said Letters Patent is hereby corrected as shown below:

Title Page and Column 1 (Title), Line 1, change “INK JET” to --INK-JET--.

Signed and Sealed this

Sixth Day of February, 2007

JON W. DUDAS
*Director of the United States Patent and Trademark Office*